US007018512B2

(12) United States Patent
von Schweinichen et al.

(10) Patent No.: US 7,018,512 B2
(45) Date of Patent: Mar. 28, 2006

(54) ROLL, IN PARTICULAR, CALENDER ROLL

(75) Inventors: Jaxa von Schweinichen, Netphen (DE); Klaus-Peter Schramm, Siegen (DE); Wolfgang Wiertz, Willich (DE); Ludwig Hellenthal, Kirchhundem (DE)

(73) Assignee: Walzen Irle GmbH, Netphen (DE)

( * ) Notice: Subject to any disclaimer, the term of this patent is extended or adjusted under 35 U.S.C. 154(b) by 431 days.

(21) Appl. No.: 10/007,587

(22) Filed: Dec. 5, 2001

(65) Prior Publication Data

US 2002/0069994 A1 Jun. 13, 2002

(30) Foreign Application Priority Data

Dec. 8, 2000 (DE) ..... 100 61 207
Feb. 21, 2001 (DE) ..... 101 08 128

(51) Int. Cl.
*D21G 1/02* (2006.01)

(52) U.S. Cl. ..... 162/361; 162/198; 492/20; 492/53; 29/895.3

(58) Field of Classification Search ..... 162/198, 162/199, 263, 272, 275, 276, 373, 374, 361, 162/362; 29/895, 895.3, 895.32, 895.1; 492/3, 492/20, 46, 53–60, 26; 148/DIG. 71, 559, 148/572, 121, 511; 451/7, 49, 53, 142
See application file for complete search history.

(56) References Cited

U.S. PATENT DOCUMENTS 3,753,276 A * 8/1973 Reisch ..... 492/59
3,775,241 A * 11/1973 Justus et al. ..... 162/199
3,944,444 A * 3/1976 Thiess et al. ..... 148/578
4,160,048 A * 7/1979 Jaeger ..... 427/455
4,607,420 A * 8/1986 Vomhoff ..... 492/5
5,096,734 A * 3/1992 Nikulainen et al. ..... 427/8
5,334,125 A * 8/1994 Vahapesola ..... 492/58
5,371,975 A * 12/1994 Lundmark ..... 451/9
5,940,969 A * 8/1999 Kuosmanen et al. ..... 29/895.1

FOREIGN PATENT DOCUMENTS

DE 37 14 187 * 4/1986

OTHER PUBLICATIONS

Smook, G.A. Handbook for Pulp and Paper Technologists, pp. 258, 259, 267 (1992).*

* cited by examiner

*Primary Examiner*—Eric Hug
(74) *Attorney, Agent, or Firm*—Friedrich Kueffner

(57) ABSTRACT

A paper processing roll for use in a calender of a paper-making machine which during operation can be exposed to increased temperatures is provided with a heat-treated surface which is produced by hot-grinding or hot-balancing or both.

15 Claims, 1 Drawing Sheet

ROLL, IN PARTICULAR, CALENDER ROLL

BACKGROUND OF THE INVENTION

1. Field of the Invention

The invention relates to a paper processing roll, in particular, for use within a paper calender, wherein the roll during operation can be exposed to increased temperature, as well as to a method for producing a roll usable in paper processing, in particular, for use in the calender of a paper-making machine.

2. Description of the Related Art

In paper processing, for example, for glossing or other treatments of the paper surface, a paper web is guided through a roll gap (nip) of a calender arrangement. This is the case in calenders or a glazing apparatus installed online or off-line, independent of their configuration. The continuously increasing production velocities and the multi-nip calenders which are currently on the market pose new requirements in regard to the quality of thermal rolls. Moreover, high-quality paper products which, in the past, have been processed without exception with off-line super calenders at considerably reduced production speeds are glazed increasingly online. This means that the calender arrangement must meet the challenge of the requirements of the paper-making machines with respect to production speed, reliability etc.

Multi-nip calenders of the newest generation make it possible to integrate a calender arrangement directly into the paper-making machines (online operation). This has the result that the calender, respectively, its rolls, must fulfill the requirements of a paper-making machine with, partially, production speeds which are considerably higher than 2,000 meters per minute. Accordingly, the calender rolls, depending on the diameter, rotate at rotational frequencies of up to values just below 1,000 rpm.

In view of the considerable size of conventional calender rolls—length of more than 10 meters, weight of several tens of tons—such an operation can result in considerable loading of the bearings which support the rolls, of the elastic roll covers provided on the counter rolls, as well as of the stands. Disruptive effects, no matter what their origin, can excite vibrations as a result of which the elastic covers will become marked and a uniform running of the rolls can no longer be ensured. The running behavior of the thermal roll can contribute to the occurrence of the widely known, but up to the present not yet solved, barring problem because, possibly, a system-own vibration can be triggered. Erratic running of the roll or the existence of a barring problem often leads to a prematurely required exchange of the rolls and an increased wear of the elastic roll covers, which cause a high economic loss for the operator of such a device.

In off-line calenders this is counteracted in that the production speed is lowered, which however does not solve the problems but simply weakens the effects (marking of the roll covers and of the product). In the case of calenders that are installed online this is not an option. In the course of the development of the new calender concepts and the continuously increasing production speeds and heating efficiencies, dimensional precision of the calender roll with respect to roll shape and concentric running under the operating conditions is of special importance. The roll shape is to be viewed as particularly critical because the calender rolls impart to the paper its optical and haptic properties and deformations of the calender rolls, even in the micrometer range, result in clearly visible imperfections of the paper quality and the properties of the elastic roll covers. The quality requirements for high-quality paper can possibly no longer be fulfilled when the roll shape is not sufficiently precise. In the case of multi-nip calenders, the roll shape is of special significance in the area where the calender roll is clamped between neighboring rolls.

In the case of online soft calenders with a single roll contact, the concentric running quality of the rolls resulting under operational load, relative to the rotational axis, must be considered primarily. Deviations from the roll barrel shape with respect to the spacing to the rotational axis must be avoided in order to prevent effects on the roll gap (nip).

SUMMARY OF THE INVENTION

It is an object of the present invention to improve the quality of paper processing rolls and to also indicate a manufacturing method such that the roll, under production conditions, in the paper-making machine assumes an optimal shape quality or concentric running quality for the process.

In accordance with the present invention, this is achieved in regard to the paper processing roll in that the paper processing roll has a surface that has been treated while hot. According to a first method of the invention, the surface of the roll is treated while hot. According to a second method of the invention, the roll is balanced while hot. According to a third method of the invention, the surface of the roll, during its manufacture, is subjected, at least partially, to cooling in order to approximate the temperature conditions during operation. This third method can be combined with the first and second methods described above. According to a fourth method of the invention, a profile of the roll in the hot state is determined and subsequently transferred as a negative profile onto the roll, after cooling of the roll, by grinding in the cold state.

With the paper processing roll according to the invention it is possible for the first time to employ such roll with satisfactory results as fast-running calender rolls and, accordingly, to integrate it directly into the paper-making machine. Also, the paper quality produced in the past on conventional calenders can be improved with the inventive roll and the risk of barring and the resulting markings and wear on the elastic covers are minimized. When the surface treatment of the rolls is carried out at a temperature which corresponds to the operating temperature present later during use, heat-caused deformations of the rolls during operation or during heating to the operating temperature are prevented. A thermal expansion will transform the roll into the state in which its surface had been machined or treated so that the precise geometry which had been produced during machining, in particular, during grinding of the roll, is regained.

As an alternative or in addition to processing of the roll surface, balancing of the respective roll at the increased temperature which is present also during later operation can be performed. It is particularly beneficial to employ a combination of hot grinding and hot balancing.

In order to be able to ensure the roll shape and surface roughness with good permanency, a coating of the roll body with chromium, oxide ceramics or a coating based on tungsten carbide or chromium carbide is possible. Inasmuch as the roll is provided with such a coating, it is particularly recommendable to subject it before coating to a hot grinding step in order to ensure uniform layer thickness after finish grinding. For the purpose of obtaining a uniform layer thickness, the finish grinding step of the roll after coating must be carried out at the temperature at which the roll has been pre-ground. As an alternative, the roll could also be ground with a predetermined profile which resulted after a hot grinding step and cooling of the roll.

When during the manufacture the roll surface is cooled at least over portions thereof, the heat transfer of a roll operating at increased operational temperature onto a paper web in contact therewith can be simulated, for example. In this way, a deformation of the roll, in particular, the creation of a polygon effect can be taken into consideration. Particularly, when the cooled area in its dimensions corresponds to the area which is in contact with the paper web during operation, the deformations resulting therefrom can be very precisely provoked during manufacture. The grinding and/or balancing can then be carried out under these deformation conditions which correspond precisely to the operating state. Accordingly, in the subsequent operation, as a result of the deformation which then occurs, a return into precisely the state during manufacture is achieved so that the machining dimensions of the manufacture process correspond precisely to the dimensions during operation. With this method, a constriction of the roll underneath the paper web is thus prevented as well as the formation of so-called oxbow effects and the creation of the polygon effect where the round contour shape of the roll is deformed to a polygon with the risk of barring. In particular the polygon effect, if no further measures are taken, can cause a considerable dimensional change and thus service limitation of the roll during operation.

DESCRIPTION OF THE PREFERRED EMBODIMENTS

Figure 1:
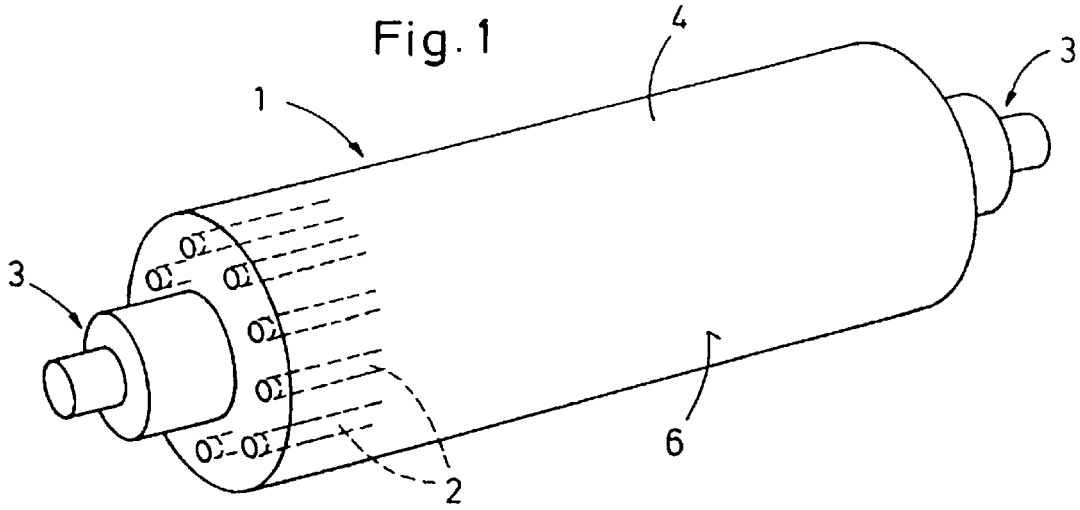
FIG. 1 is a perspective view of a roll provided with axial bores for guiding a heating medium therethrough.
Figure 2:
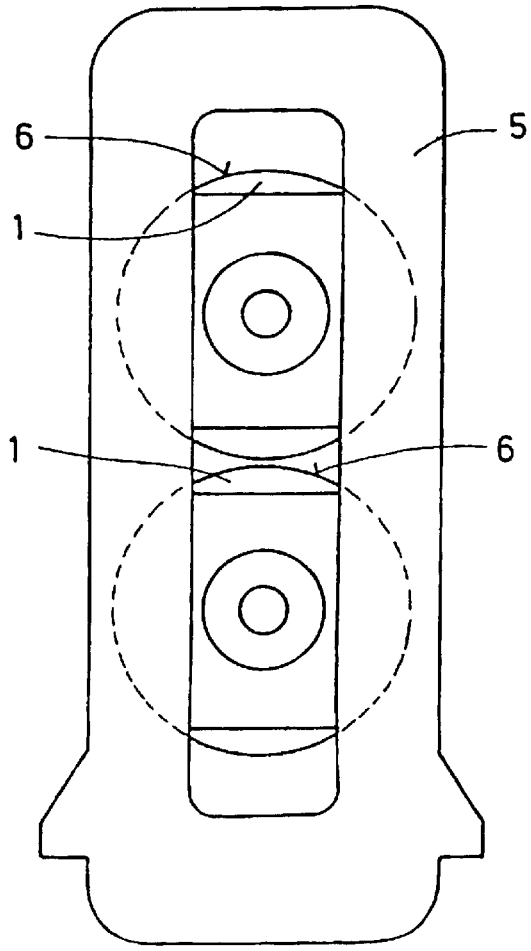
FIG. 2 is a schematic illustration of a calender arrangement of two rolls positioned atop one another.

In the illustrated embodiment, a heatable roll 1 with inner bores 2 is illustrated. The bores 2 extend axially and are provided for guiding a heating medium through during operation (paper making) and during manufacture of the roll 1. The heating medium can be a pre-heated fluid such a heat carrier oil, water or steam. The bores 2 can be provided, for example, in the mantle of the hollow-cylindrical roll 1.

For clamping the roll 1, symmetrically formed flange journals 3 are provided which limit the roll body 4 at both ends and which point outwardly in order to be received in bearing eyes of a stand 5.

Typical paper processing rolls 1, which are used as calender rolls for calendering a paper web, are comprised, for example, of chilled iron, centrifugal casting or also, up to a certain degree, of forged steel. Such materials are inhomogeneous (anisotropic and orthotropic) which, with respect to the shaping precision is particularly problematic. The dimensions of the rolls 1 are predetermined by the width of the paper web. The rolls 1 are therefore several meters long. Typically, the roll length is approximately more than three meters. The weight can be up to 90 tons.

During the paper making process, for example, when glazing a paper web, the rolls 1 are kept at an increased temperature. This temperature is, for example, in the range of 50° C. to 250° C. In the paper processing roll 1 according to the invention the bores 2 fulfill a double function: they serve, on the one hand, for guiding fluid through the roll while the roll 1 is in use in the paper-making process and, on the other hand, they are provided for guiding therethrough a fluid, also serving for heat introduction, during the manufacture of the roll 1.

For manufacturing or processing the roll body 4 it is provided with a rotary transmission leadthrough for the heating medium. Accordingly, through the bores 2 the heating medium can be introduced. The heating medium introduction is carried out with slow roll rotation until a constant temperature of the roll 1 has been reached. In this regard, the temperature must be constant and substantially uniform across the entire roll surface 6.

As soon as the temperature adjustment has been reached, the hot grinding step is carried out at the adjusted high temperature. This grinding step, depending on the surface temperature, is usually a dry grinding step. For the grinding step, ceramically bound silicon carbide or special fused alumina grinding wheels or other ceramically bound grinding media of sufficient hardness are employed. The grinding machine is usually numerically controlled (CNC control).

In the manufacturing process, the roll 1 is exposed to the same temperature as during its later use. For a use at a temperature range this would then be, for example, the medium temperature of the temperature range. Accordingly, the thermally caused deformations during use are minimized. For monitoring the temperature during manufacture, highly precise temperature measuring devices are used. During the surface treatment of the roll 1 it is held in fixed stays by center sleeves. The roll is secured by flange journals 3 in slide bearings. Securing in roller bearings, for example, cylindrical roller bearings/spherical roller bearings, is possible in order to take into consideration the situations under operating conditions.

After hot grinding, the paper processing roll is checked for shape and precision of roundness. An after correction is possible.

Only then cooling with slow rotation of the roll 1 is carried out. Thermal deformations which occur in this connection are reversible in that upon reheating of the roll 1 for the paper processing operation the deformations will be cancelled. Accordingly, the shape properties correspond to those during the hot grinding step.

In an alternative configuration the roll surface 6 is coated and hot-ground. Such a coating can be, in particular, a carbide layer, for example, a tungsten carbide layer.

In addition or alternatively to the hot treatment of the roll surface 6, a hot balancing of the roll 1 can be performed. This not only makes it possible to adjust the shape properties of the roll 1 to the conditions during operation, but also to adjust the running properties which is very important in view of the significant roll size and roll mass.

Particularly advantageous is a manufacturing process of a roll in which it is hot-ground as well as hot-balanced. In this situation, the shape and running properties are most precisely adjusted to the later operating conditions.

The balancing can react to the change of the mass distribution during hot grinding and can thus realize very high precision. This hot balancing is not only of interest for paper processing rolls but also for other rolls of a large size which are subjected to a high operating temperature and speed.

The application of a hot-grinding and/or hot-balancing method for a paper calender roll is however particularly advantageous because the precision in regard to the surface processing required in this connection is much greater than in other areas and because the paper speed is very high. The required surface quality is achieved with high quality with a tungsten carbide layer or a similar surface layer which is also hot-ground. Only with these measures it was possible to obtain such satisfactory results that the use of such paper calender rolls of the aforementioned size and weight in mass production was enabled.

The shape error of a calender roll which has not been hot-ground at the operating temperature, which error has been within the magnitude of up to 300 μm, can be lowered with the invention to less than 5 μm (round) and 10 μm (cylindrical).

In the illustrated embodiment the described hot-grinding and/or hot-balancing method is realized in combination with cooling of the roll surface 6 so that the heat transfer occurring during operation onto goods to be rolled, for example, a paper web, can be simulated close to operational conditions. With the combination of heating, on the one hand, and surface cooling, on the other hand, a complete anticipation of the operating conditions can be adjusted and the machining or treating of the roll 1 can be performed for this temperature loading.

The cooling relates to the running surface of the roll 1, i.e., to the area of the surface 6 which during operation is in contact with the paper web. Also, the temperature of the cooling medium during manufacture corresponds approximately to the temperature of the paper web.

For cooling the roll 1, a second roll can be used, for example, which is supported parallel to the roll 1 to be processed and is in contact therewith. The second roll is coolable, for example, by inner cooling by means of a fluid or also by surface cooling. The contact to the surface 6 of a roll 1 can be realized by means of a (cooling) cover. This second roll makes possible, by being entrainable in rotation, also the cooling contact to the roll 1 during its fast rotation.

As an alternative, a cooling beam can be used which is, for example, covered with a moist cover of felt or a similar soft absorbent material and is pressed with this cover against the surface 6 of the roll 1.

Also, an immersion bath, which is held approximately at the temperature of a paper web, is possible for surface cooling.

Also, the surface 6 of the roll 1 can be subjected to blowing, for example, a gas, in particular, air, or a gas-fluid mixture, for example, and air/water mist, which gas or gas-fluid mixture also has substantially the temperature of the paper web to be rolled later.

At the end of the manufacturing process, a roll 1 is then provided whose core is heated to a higher temperature than its surface 6. Accordingly, an irregular deformation after manufacture results. The deformation is however reversed again during the paper-making operation to the conditions during manufacture so that the precise dimensions of the roll are ensured during operation.

While specific embodiments of the invention have been shown and described in detail to illustrate the inventive principles, it will be understood that the invention may be embodied otherwise without departing from such principles.

What is claimed is:

1. A paper processing roll, wherein the roll is configured to be exposed to an increased temperature during operation, wherein the roll has a surface which has been treated while hot prior to use of the roll, wherein the roll has a coating and the surface is comprised of the material of the coating, wherein the coating is comprised of a material selected from the group consisting of chromium, carbide, and oxide, wherein the roll is machined before and/or after coating at increased temperature.

2. The paper processing roll according to claim 1, wherein the roll has a hot-ground surface.

3. The paper processing roll according to claim 1, wherein the surface of the roll is treated at 50° C. to 250° C.

4. The paper processing roll according to claim 1, wherein the coating is comprised of tungsten carbide or chromium oxide.

5. The paper processing roll according to claim 1, wherein the roll is ground.

6. The paper processing roll according to claim 1, wherein the roll is hot-balanced.

7. A method for producing a roll for use in paper making, comprising the step of treating the surface of the roll while hot prior to use of the roll, wherein the step of treating the roll comprises hot-grinding the roll, further comprising the step of surface coating the roll after the step of hot-grinding the roll.

8. The method according to claim 7, wherein the roll is treated at temperature which corresponds substantially to a projected temperature of use.

9. A method for producing a roll for use in paper making, comprising the step of balancing the roll while hot, further comprising the step of treating the surface of the roll while hot.

10. A method for producing a roll for use in paper making, comprising the step of cooling the surface of the roll manufacture of the roll at least over portions thereof for approximating the temperature conditions during operation in paper making, wherein the step of cooling comprises the step of contacting the surface area of the roll during manufacture of the roll with a cooling liquid.

11. The method according to claim 10, wherein the surface area being cooled corresponds to an area of the roll exposed to a paper web during operation.

12. A method for producing a roll for use in paper making, comprising the step of cooling the surface of the roll during manufacture of the roll at least over portions thereof for approximating the temperature conditions during operation in paper making, wherein the step of cooling comprises the step of contacting the surface area of the roll during manufacture of the roll with a roll or band provided with a cooling cover.

13. A method for producing a roll for use in paper making, comprising the step of cooling the surface of the roll during manufacture of the roll at least over portions thereof for approximating the temperature conditions during operation in paper making, wherein the step of cooling comprises the step of contacting the surface area of the roll during manufacture with a cooling beam which is pressure-loaded against the roll.

14. A method for producing a roll for use in paper making, comprising the step of cooling the surface of the roll during manufacture of the roll at least over portions thereof for approximating the temperature condition during operation in paper making, wherein the step of cooling comprises the step of blowing a gas or a gas/fluid mixture against the surface area of the roll.

15. A method for producing a roll for use in paper making, comprising the steps of:

determining a hot profile of the roll while the roll is hot;

cooling down the roll;

subsequently cold grinding the roll to transfer the determined hot profile of the roll as a negative profile onto the roll.

* * * * *